US009528072B2

(12) United States Patent
Abraham et al.

(10) Patent No.: US 9,528,072 B2
(45) Date of Patent: Dec. 27, 2016

(54) FARM TRACTOR LUBRICATING COMPOSITION WITH GOOD WATER TOLERANCE

(75) Inventors: William D. Abraham, Concord, OH (US); Marina Baum, Chagrin Falls, OH (US); Haihu Qin, Greer, SC (US); Ying Wang, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 506 days.

(21) Appl. No.: 13/393,615

(22) PCT Filed: Sep. 7, 2010

(86) PCT No.: PCT/US2010/047947

§ 371 (c)(1),
(2), (4) Date: May 18, 2012

(87) PCT Pub. No.: WO2011/031659

PCT Pub. Date: Mar. 17, 2011

(65) Prior Publication Data

US 2012/0220505 A1 Aug. 30, 2012

Related U.S. Application Data

(60) Provisional application No. 61/242,092, filed on Sep. 14, 2009.

(51) Int. Cl.
*C10M 167/00* (2006.01)
*C10N 40/08* (2006.01)

(52) U.S. Cl.
CPC ..... *C10M 167/00* (2013.01); *C10M 2207/126* (2013.01); *C10M 2207/127* (2013.01); *C10M 2207/288* (2013.01); *C10M 2209/084* (2013.01); *C10M 2215/042* (2013.01); *C10M 2215/08* (2013.01); *C10M 2215/28* (2013.01); *C10M 2217/02* (2013.01); *C10M 2217/024* (2013.01); *C10M 2219/046* (2013.01); *C10M 2223/043* (2013.01); *C10M 2223/047* (2013.01); *C10M 2223/049* (2013.01); *C10N 2040/08* (2013.01); *C10N 2220/021* (2013.01); *C10N 2220/14* (2013.01); *C10N 2230/24* (2013.01); *C10N 2230/26* (2013.01); *C10N 2230/66* (2013.01); *C10N 2240/044* (2013.01); *C10N 2240/08* (2013.01); *C10N 2260/14* (2013.01)

(58) Field of Classification Search
USPC ..... 508/470, 471
See application file for complete search history.

(56) References Cited

U.S. PATENT DOCUMENTS

| | | | | |
|---|---|---|---|---|
| 7,691,797 | B2 * | 4/2010 | Schmidt et al. | 508/469 |
| 8,101,559 | B2 * | 1/2012 | Mueller et al. | 508/469 |
| 8,288,327 | B2 * | 10/2012 | Dardin et al. | 508/469 |
| 8,513,172 | B2 * | 8/2013 | Baum et al. | 508/469 |
| 8,722,601 | B2 * | 5/2014 | Mueller et al. | 508/469 |
| 8,835,367 | B2 * | 9/2014 | Baum et al. | 508/464 |
| 2006/0189490 | A1 | 8/2006 | Dardin et al. | |
| 2006/0276352 | A1 | 12/2006 | Vinci | |
| 2007/0270317 | A1 * | 11/2007 | Milner et al. | 508/460 |
| 2009/0215657 | A1 * | 8/2009 | Ripple | 508/186 |
| 2011/0263470 | A1 * | 10/2011 | Qin et al. | 508/507 |
| 2011/0294707 | A1 * | 12/2011 | Abraham | 508/273 |

FOREIGN PATENT DOCUMENTS

| | | | |
|---|---|---|---|
| EP | 0265254 | A2 | 4/1988 |
| EP | 1990400 | | 11/2008 |
| WO | 2005056739 | | 6/2005 |
| WO | 2006047393 | | 5/2006 |
| WO | 2008076825 | A1 | 6/2008 |
| WO | 2010053890 | | 5/2010 |

OTHER PUBLICATIONS

Corresponding PCT Publication No. WO2011/031659 A1 & Search Report published Mar. 17, 2011.
Written Opinion from corresponding International Application No. PCT/US2010/047947 dated Nov. 22, 2010.

* cited by examiner

*Primary Examiner* — Ellen McAvoy
(74) *Attorney, Agent, or Firm* — David M. Shold, Esq.; Teresan W. Gilbert, Esq.

(57) ABSTRACT

A lubricant of (a) an oil of lubricating viscosity; (b) a block copolymer of (i) a hydrophobic first block of $C_{1-30}$ alkyl (meth)acrylic units having an average total number of carbon atoms of at least 8; and (ii) a second block of (meth) acrylic units, at least some units of which comprise a heteroatom imparting polar character to the block; (c) an overbased calcium detergent; (d) a phosphorus-containing anti-wear agent that does not contribute to the metal content of the lubricant; and (e) a friction modifier suitable to reduce the static coefficient of friction at a metal-composition interface, is suitable for lubricating a farm tractor.

14 Claims, No Drawings

FARM TRACTOR LUBRICATING COMPOSITION WITH GOOD WATER TOLERANCE

BACKGROUND OF THE INVENTION

The disclosed technology relates to a fluid useful as a lubricant or a functional fluid, especially lubricating a vehicle, in particular an off-road vehicle such as a farm tractor, or a vehicle comprising a manual transmission. The technology involves the use of an amphiphilic diblock polymer as a water tolerance agent.

Traditional lubricants used for many off-road vehicle applications, and in particular farm tractor applications, are based on engine oil lubricants, despite the fact that farm tractor applications have additional technical lubricating requirements beyond those in lubricating a gasoline or diesel internal combustion engine. Reflecting their engine-oil heritage, most farm tractor lubricants include relatively large quantities of overbased metal detergents. The detergents typically are beneficial for providing a low level of static coefficient of friction, which is desirable for lubricating the metal-composition interface of the wet-brake component of a farm tractor. Detergents also aid in water tolerance, that is, adequate and stable dispersion of water contamination within the lubricant. However, high levels of detergents have been associated with excessive wear. Also characteristic of an engine oil, zinc dialkyldithiophosphates (ZDDPs) have typically been included in farm tractor fluid as antiwear agents to address wear problems. However, ZDDPs may cause corrosion problems, especially in the presence of water. Moreover, ZDDPs can cause friction durability issues with transmission clutch material and wet brake material under high-energy-producing conditions.

It is desired to provide a farm tractor fluid that is free from zinc dialkyldithiophosphates (or has a significantly reduced level thereof) in order to reduce or eliminate the corrosion problem and other problems. Then, however, to reduce or eliminate the wear problem, which would be expected to become more severe without the ZDDP, it is also desired to reduce the amount of detergent. Yet with these changes it remains necessary to retain a low static coefficient of friction (normally provided by the detergent) for lubricating the wet brake, all the while retaining antioxidancy properties and water tolerance.

A number of materials have been used in an attempt to provide water tolerance to lubricants. Among these are materials that have commonly been used as dispersants in engine lubricants, and in particular certain hydrocarbyl-substituted succinic acid esters. For instance, the condensation product of polyisobutylenesuccinic anhydride and diethylaminoethanol has been used to improve water tolerance in certain lubricant formulations, but it alone is often insufficient.

In short, it is a very difficult challenge to find a suitable balance, among competing performance requirements and component properties, in order to design a fully satisfactory farm tractor lubricant.

U.S. Patent Application 2006/0189490 discloses a lubricating composition containing base oil and at least one additive having friction-modifying properties. The additive is a linear diblock copolymer which includes hydrophobic segments P and polar segments D, said hydrophobic segments being obtained by polymerization of monomer compositions which comprise 0 to 40% of $C_{1-5}$ alkyl (meth) acrylates, 50 to 100% of $C_{6-30}$ alkyl (meth)acrylates, and 0 to 50% of a polar group containing ester, thioester or amide functionality.

International publication WO2006/047393 discloses linear and star RAFT polymers as viscosity index improvers in a variety of lubricants. The RAFT polymers may have a variety of architectures including diblock copolymers. All of polymers are derived from $C_{12-15}$ alkyl (meth)acrylates.

SUMMARY OF THE INVENTION

The disclosed technology provides a lubricant composition comprising (a) an oil of lubricating viscosity; (b) a block copolymer comprising: (i) at least one hydrophobic block (e.g., a first block) having $C_{1-30}$ alkyl (meth)acrylic units, with the proviso that alkyl groups of the $C_{1-30}$ alkyl (meth) acrylic units have a number average number of carbon atoms of at least 8; and (ii) at least one additional (or second) block having (meth)acrylic units, at least some units of which comprise a heteroatom in the non-acid portion of the (meth) acrylic unit, imparting polar character to said additional or second block in excess of the polar character of the hydrophobic (first) block; (c) at least one overbased calcium or magnesium detergent in an amount to provide a total calcium plus magnesium concentration in the lubricant of 0.015 to 0.35 or to 0.15 percent by weight; (d) at least one phosphorus-containing anti-wear agent that does not contribute to the metal content of the lubricant; and (e) at least one friction modifier suitable to reduce the static coefficient of friction between surfaces.

The disclosed technology also discloses a method for lubricating a vehicle (e.g., an off-road vehicle) comprising supplying thereto the above composition.

DETAILED DESCRIPTION OF THE INVENTION

Various preferred features and embodiments will be described below by way of non-limiting illustration.

One of the components of the present technology is an oil of lubricating viscosity (a). Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil break-down products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (typically hydrogenated) (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube® 3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity includes an API Group I, Group II, Group III, Group IV, Group V oil or mixtures thereof. Often the oil of lubricating viscosity is an API Group I, Group II, Group III, Group IV oil or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein above is in the form of a concentrate (which may be combined with additional oil to form, in whole or in part, a finished lubricant)), the ratio of the of these additives to the oil of lubricating viscosity and/or to diluent oil include the ranges of 1:99 to 99:1 by weight, or 10:90 to 80:20 by weight.

The amount of each chemical component (other than oil) is presented herein exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

Certain of the materials referred to herein may be esters or amides of the general structures R—C(O)—OR' or R—C(O)—NHR' or R—C(O)—NR'R". These may be viewed as the condensation product of a carboxylic acid, RC(O)OH, with an alcohol or an amine, HOR', HNHR', or HNR'R", even if not in fact prepared by a condensation reaction. For definitional purposes, the R—C(O) portion of such structures may be referred to as the acid-portion of the structure. Likewise, the OR', NHR', or NR'R" portion of the structures may be referred to as the alcohol or amine portion of the structure, respectively, or in general, as the non-acid portion. Reference to "a heteroatom in the non-acid portion" means a heteroatom (e.g., O, N, S, or optionally, e.g., P, halogen) in addition to the O or N which is bonded to the acid portion of the molecule. The heteroatom may be within a carbon chain or as substituent or part of a substituent on a carbon chain.

The block copolymer (b) is a material that may provide water-emulsifying properties to the lubricant formulations, and optionally also pour-point-depressant properties. In one embodiment, the block copolymer is a diblock copolymer comprising:

(a) a hydrophobic (or first) block having $C_{1-30}$ alkyl (meth)acrylic units, wherein at least 50 wt % of the $C_{1-30}$ alkyl (meth)acrylic units are $C_{12-15}$ alkyl (meth)acrylic units, and up to 50 wt % of the $C_{1-30}$ alkyl (meth)acrylic units are $C_{16-20}$ alkyl (meth)acrylic units, with the proviso that alkyl groups of the $C_{1-30}$ alkyl (meth)acrylic units have an average total number of carbon atoms of at least 8; and (b) a second block having (meth)acrylic units further having a heteroatom group providing a polar group.

The weight percents of monomers within the block, above, are calculated based on the weight percent of the entire alkyl (meth)acrylic monomer units. Reference herein to "first" and "second" block is primarily for purpose of identification. The hydrophobic block may in fact be the first block to be polymerized, followed by the heteroatom-containing group, or the order may be reversed.

As used herein, the term "polar" is used in the ordinary sense of the word and is also known to mean hydrophilic. In the polymers of the present invention, one block is a hydrophobic or relatively hydrophobic block comprising one or more hydrophobic monomers, and the other, a hydrophilic block. The terms "hydrophobic" and "hydrophilic," when applied to the monomers or polymers of this technology, are used in their ordinary sense. That is, hydrophilic, when it refers to a polymer, means that the polymer has a strong tendency to bond with or absorb water, which can result in solution of the polymer or swelling and formation of a reversible gel. This property is characteristic of polymers prepared from polar or ionic monomers. Similarly, hydrophobic, when it refers to a polymer, means that the polymer is antagonistic to water and generally cannot be dissolved in or swelled by water. This property is characteristic of polymers prepared from relatively non-polar monomers.

While the terms "hydrophobic" and "hydrophilic" may not necessarily be capable of unequivocal quantitative definition, they are generally well understood by those skilled in the art. Hydrophilic monomers are those which interact favorably with water, often characterized by a measure of solubility in water or similarly polar solvents. Hydrophobic monomers exhibit little or no favorable interaction with water and are generally not appreciably soluble in water or similarly polar solvents. The hydrophobic or hydrophilic character of a monomer can also be understood to approximately correlate with results derived from the octanol/water partition test. The original form of this test, involving measurement of the equilibrium concentration of a dissolved substance in a two-phase system of n-octanol and water, as well as a chromatographic method, are described in ASTM E-1147-92. $P = C^{octanol}/C^{water}$. The hydrophilic or hydrophobic nature of a monomer can be evaluated by comparing its P value with the P values of those monomers categorized as hydrophilic or hydrophobic. For many hydrophilic chemicals, log P is about 0.8 or less, commonly 0.7 or less. That of acrylic acid, for instance, is about 0.4. For many hydrophobic chemicals, log P is greater than 0.8, more commonly 0.9 or greater. That of ethylbenzene, for example, is about 3.1. A listing of log P values of many chemicals as well as a theoretical discussion of partition coefficients can be found in Leo et al., *Chemical Reviews,* 71, 6, pp. 528-616 (1971).

In one embodiment, the diblock copolymer product may be obtained or is obtainable by a process comprising:

(1) contacting: (i) a free radical initiator; (ii) a chain transfer agent (typically containing a thiocarbonyl thio group useful in RAFT polymerization processes); and (iii) one or more $C_{1-30}$ alkyl (meth)acrylic monomer units, wherein at least 50 wt % of the $C_{1-30}$ alkyl (meth)acrylic monomer units contain $C_{12-15}$ alkyl (meth)acrylic units, and up to 50 wt % of the $C_{1-30}$ alkyl (meth)acrylic units are $C_{16-20}$ alkyl (meth)acrylic units, with the proviso that alkyl groups of the $C_{1-30}$ alkyl (meth)acrylic units have an average total number of carbon atoms of at least 8, to form a polymer;

wherein the process of step (1) is typically a polymerization process with "living" characteristics (for instance a controlled radical polymerization process); and wherein at least about 50 wt % of the polymer chains from step (1) contain a reactive end group capable of reacting with a polyvalent coupling agent;

(2) optionally contacting the polymer of step (1) with a polymerization inhibitor; and (3) contacting the polymer of step (1) or step (2) with one or more (meth)acrylic units, typically at least 50 wt % or at least 75 wt % of said units further containing a heteroatom group in the non-acid portion. The remainder of units in the hydrophilic block (regardless of preparation route) may be, e.g., alkyl (meth)acrylic units, wherein the alkyl group may have 1-30 carbon atoms, e.g., methyl (meth)acrylate. The amount of non-heteroatom units in the hydrophilic block may be, e.g., 0 to 50 or 1 to 25 or 2 to 20 or 3 to 10 weight percent.

In the process described above, the first step of the process may be performed in the presence of a mineral oil, synthetic oil, hexane, toluene, tetrahydrofuran, or other known polymerization solvents.

In an alternative process, a diblock copolymer product is obtainable by a process as described above except that the (meth)acrylic units in step 1 and step 3 may be switched; that is, the (meth)acrylic units in step 1 may contain a heteroatom group (typically at least 50 weight percent or at least 75 weight percent containing a heteroatom group) and the (meth)acrylic units in step 3 may contain the mixture of alkyl (meth) acrylic monomer units as described above.

The processing temperatures, pressures, and reagents are known to a person skilled in the art of controlled radical polymerization techniques. References describing such materials include WO2006/047393 and the various references disclosed hereinbelow in the further description of the diblock copolymer.

The resulting block copolymer may comprise: (a) a hydrophobic first block having $C_{1-30}$ alkyl (meth)acrylic units, with the proviso that alkyl groups of the $C_{1-30}$ alkyl (meth)acrylic units have an average total number of carbon atoms of at least 8; and (b) a second block having (meth) acrylic units further having a heteroatom group providing a polar group. The hydrophobic first block may comprise $C_{1-30}$ alkyl (meth)acrylic units, wherein at least 50 wt % of the $C_{1-30}$ alkyl (meth)acrylic units are $C_{12-15}$ alkyl (meth) acrylic units, and up to 50 wt % of the $C_{1-30}$ alkyl (meth) acrylic units are $C_{16-20}$ alkyl (meth)acrylic units, with the proviso, again, that alkyl groups of the $C_{1-30}$ alkyl (meth) acrylic units have an average total number of carbon atoms of at least 8. The second block may comprise (meth)acrylic units further having a heteroatom group providing a polar group. In one embodiment the block copolymer may be an emulsifier and/or pour point depressant, and the block copolymer may be used, in the context of the present technology, as an emulsifier and/or pour point depressant.

Emulsifier properties may occur for any block copolymer composition as described herein. Both emulsifier and pour point depressant properties typically occur when the diblock block copolymer contains $C_{16-20}$ alkyl (meth)acrylic units and $C_{12-15}$ alkyl (meth)acrylic units.

As used herein the term "(meth)acrylic units" includes both (or either) acrylic and methacrylic units, and the units are derived from an appropriate monomer. The (meth) acrylic units typically include methacrylates, acrylates, methacrylamides, acrylamides, or mixtures thereof.

The molecular weight of the block copolymer may be determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312.

The block copolymer may be a diblock, a triblock, or a higher block copolymer. It may also have star or comb architecture. The diblock copolymer may have a AB composition, where A is a hydrophobic unit, and B is a hydrophilic unit. That is, the B unit is more hydrophilic than the A unit. The triblock copolymer may have ABA or BAB, ABA', or BAB', where A and B are defined above, and A' and B' represent hydrophobic and hydrophilic units different from A and B, respectively. Each block may be of a random copolymer structure, a sequential copolymer structure, or may have a random or sequential distribution of two or more monomer units. Typically, the block copolymer may be a linear diblock copolymer.

The weight average molecular weight of the block copolymer may be in the range of 1000 to 400,000, or 1000 to 150,000, or 10,000 to 150,000, or 15,000 to 100,000. The weight ratio of the second block to the first block may be in the range of 1:2 to 1:100, or 1:4 to 1:30, or 1:6 to 1:18. That is, the weight ratio of the hydrophobic block or blocks to the additional block or blocks may be 2:1 to 100:1, or 4:1 to 30:1, or 6:1 to 18:1. The ratio of the length of the first block to that of the second block may be 10:1 to 1:10, or 6:1 to 1:2. The weights and ratios may be calculated with reference to the amounts of monomers charged to the polymerization reaction.

The $C_{1-30}$ alkyl (meth)acrylic units may be derived from an alkyl (meth)acrylate. The alkyl (meth)acrylate includes, for example, compounds derived from saturated alcohols, such as methyl methacrylate, butyl methacrylate, 2-methylpentyl (meth)acrylate, 2-propylheptyl (meth)acrylate, 2-butyloctyl (meth)acrylate, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, octadecyl (meth)acrylate, nonadecyl (meth)acrylate, eicosyl (meth)acrylate, cetyleicosyl (meth)acrylate, stearyleicosyl (meth)acrylate, docosyl (meth)acrylate and/or eicosyltetratriacontyl (meth)acrylate; as well as (meth)acrylates derived from unsaturated alcohols, such as oleyl (meth)acrylate; and cycloalkyl (meth) acrylates, such as 3-vinyl-2-butylcyclohexyl (meth)acrylate or bornyl (meth)acrylate.

The alkyl (meth)acrylates with long-chain alcohol-derived groups may be obtained, for example, by reaction of a (meth)acrylic acid (by direct esterification) or methyl methacrylate (by transesterification) with long-chain fatty alcohols, in which reaction a mixture of esters such as (meth) acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann. In one embodiment the block copolymer may be a methacrylate polymer.

The hydrophobic first block may contain 70 wt % or more, or 80 wt % or more of the $C_{1-30}$ alkyl (meth)acrylic units containing $C_{12-15}$ alkyl (meth)acrylic units. The percent referred to is weight percent based on the entire monomer unit. The hydrophobic first block may contain up to 30 wt %, or up to 20 wt % of the $C_{1-30}$ alkyl (meth)acrylic units containing $C_{16-20}$ alkyl (meth)acrylic units. In one embodiment the hydrophobic first block contains $C_{1-30}$ alkyl (meth)acrylic units, wherein at least 70 wt % of the $C_{1-30}$ alkyl (meth)acrylic units may be $C_{12-15}$ alkyl (meth)acrylic units, and up to 30 wt % of the $C_{1-30}$ alkyl (meth)acrylic units are $C_{16-20}$ alkyl (meth)acrylic units, with the proviso that alkyl groups of the $C_{1-30}$ alkyl (meth)acrylic units have an average total number of carbon atoms of at least 8 (or at least 10 carbon atoms). In one embodiment the hydrophobic first block contains $C_{1-30}$ alkyl (meth)acrylic units, wherein at least 80 wt % of the $C_{1-30}$ alkyl (meth)acrylic units may be $C_{12-15}$ alkyl (meth)acrylic units, and up to 20 wt % of the $C_{1-30}$ alkyl (meth)acrylic units are $C_{16-20}$ alkyl (meth)acrylic units, with the proviso that alkyl groups of the $C_{1-30}$ alkyl (meth)acrylic units have an average total number of carbon atoms of at least 8 (or at least 10 carbon atoms).

The second block comprises (meth)acrylic units that have a heteroatom group providing the polar group in the non-acid portion of the structure with the heteroatom including sulfur, nitrogen, oxygen (such as non-carbonyl oxygen), phosphorus, or mixtures thereof. In one embodiment the heteroatom may be nitrogen. The term "non-carbonyl oxygen" is not meant to exclude the presence of a carbonyl oxygen, but rather to indicate that if such is present, there may also be a heteroatom that is not a carbonyl oxygen (that is, neither an oxygen atom of an aldehyde, ketone or either oxygen atoms of a carboxylic acid or ester).

In one embodiment the copolymer of the invention further includes a heteroatom group derived from a nitrogen- or oxygen-containing group. The group may be derived from a nitrogen- or oxygen-containing compound capable of being incorporated during copolymerization. The nitrogen or oxygen containing group may be derived from an aminoalkyl (meth)acrylamide or a nitrogen containing (meth)acrylate monomer that may be represented by the formula:

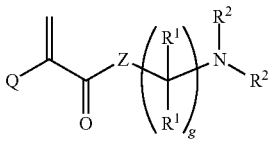

wherein

Q is hydrogen or methyl and, in one embodiment, Q is methyl;

Z is an N—H group or O (oxygen);

each $R^1$ is independently hydrogen or a hydrocarbyl group containing 1 to 2 carbon atoms and, in one embodiment, each $R^1$ is hydrogen;

each $R^2$ is independently hydrogen or a hydrocarbyl group containing 1 to 8, or 1 to 4 carbon atoms; and g is an integer in ranges including 1 to 6, or 1 to 3.

Examples of suitable nitrogen-containing compounds capable of being incorporated into the copolymer include N,N-dimethylacrylamide, N-vinyl carbonamides (such as N-vinyl-formamide, N-vinylacetoamide, N-vinyl propionamides, N-vinyl hydroxyacetoamide, vinyl pyridine, N-vinyl imidazole, N-vinyl pyrrolidinone, N-vinyl caprolactam, dimethylaminoethyl acrylate, dimethylaminoethyl methacrylate, dimethylaminobutylacrylamide, dimethylaminopropyl methacrylate, dimethylaminopropyl acrylate, dimethylaminopropylacrylamide, dimethylaminopropylmethacrylamide, dimethylaminoethylacrylamide or mixtures thereof.

In one embodiment the heteroatom group derived from a nitrogen-containing group may include dimethylaminoethyl acrylate, dimethylaminoethyl methacrylate, dimethylaminopropyl methacrylate, dimethylaminopropyl acrylate, dimethylaminopropylacrylamide, dimethylaminopropylmethacrylamide, nitriles of (meth)acrylic acid and other nitrogen-containing (meth)acrylates, such as N-(methacryloyloxyethyl)diisobutyl ketimine, N-(methacryloyloxyethyl)dihexadecyl ketimine, methacryloylamidoacetonitrile, 2-methacryloyloxyethylmethylcyanamide, cyanomethyl methacrylate, or mixtures thereof.

Examples of suitable non-carbonyl oxygen containing compounds capable of being incorporated into the copolymer include hydroxyalkyl (meth)acrylates such as 3-hydroxypropyl methacrylate, 3,4-dihydroxybutyl methacrylate, 2-hydroxyethyl methacrylate, 2-hydroxyethyl acrylate, 2-hydroxypropyl methacrylate, 2,5-dimethyl-1,6-hexanediol (meth)acrylate, 1,10-decanediol (meth)acrylate, carbonyl-containing methacrylates such as 2-carboxyethyl methacrylate, carboxymethyl methacrylate, oxazolidinylethyl methacrylate, N-(methacryloyloxy)formamide, acetonyl methacrylate, N-methacryloylmorpholine, N-methacryloyl-2-pyrrolidinone, N-(2-methacryloyloxyethyl)-2-pyrrolidinone, N-(3-methacryloyloxypropyl)-2-pyrrolidinone, N-(2-methacryloyloxypentadecyl)-2-pyrrolidinone, N-(3-methacryloyloxyheptadecyl)-2-pyrrolidinone; glycol dimethacrylates such as 1,4-butanediol methacrylate, 2-butoxyethyl methacrylate, 2-ethoxyethoxymethyl methacrylate, 2-ethoxyethyl methacrylate, or mixtures thereof. Other examples of suitable non-carbonyl oxygen containing compounds capable of being incorporated into the copolymer include methacrylates of ether alcohols, such as tetrahydrofurfuryl methacrylate, vinyloxyethoxyethyl methacrylate, methoxyethoxyethyl methacrylate, 1-butoxypropyl methacrylate, 1-methyl-(2-vinyloxy)ethyl methacrylate, cyclohexyloxymethyl methacrylate, methoxymethoxyethyl methacrylate, benzyloxymethyl methacrylate, furfuryl methacrylate, 2-butoxyethyl methacrylate, 2-ethoxyethoxymethyl methacrylate, 2-ethoxyethyl methacrylate, allyloxymethyl methacrylate, 1-ethoxybutyl methacrylate, methoxymethyl methacrylate, 1-ethoxyethyl methacrylate, ethoxymethyl methacrylate and ethoxylated (meth)acrylates which typically have 1 to 20, or 2 to 8, ethoxy groups, or mixtures thereof. In certain embodiments an oxygen-containing group may be 2-hydroxyethyl acrylate or 2-hydoxyethyl methacrylate or mixtures thereof.

The block copolymer may be obtained/obtainable from controlled radical or other living polymerization techniques such as RAFT (Reversible Addition Fragmentation Transfer), ATRP (Atom Transfer Radical Polymerization), nitroxide-mediated and anionic polymerizations. These polymerization techniques are known to a person skilled in the art. Anionic polymerization processes may be useful when the heteroatom of the second block contains a nitrogen heteroatom (from an amine) when steps are taken to quench the amine during polymerization. Such techniques are known to a person skilled in the art. More detailed descriptions of polymerization mechanisms and related chemistry is discussed for nitroxide-mediated polymerization (Chapter 10, pages 463 to 522) of in the Handbook of Radical Polymerization, edited by Krzysztof Matyjaszewski and Thomas P. Davis, 2002, published by John Wiley and Sons Inc (hereinafter referred to as "Matyjaszewski et al.").

In one embodiment the controlled radical polymerization process employed to prepare the block copolymer may be a RAFT process. A detailed description of RAFT processes is described in WO2006/047393 (see whole document for reagents, and reference to linear polymers) or US Patent Application 2006/0189490 (see paragraphs [0128] to [0131]). In one embodiment the controlled radical polymerization process employed to prepare the block copolymer may be an ATRP process. In ATRP polymerization, groups that may be transferred by a radical mechanism include halogens (from a halogen-containing compound) or various ligands. A more detailed review of groups that may be transferred is described in U.S. Pat. No. 6,391,996, or paragraphs 61 to 65 of U.S. Patent Application 2005/038146. Another detailed description of ATRP processes is described in U.S. Patent Application 2006/0189490 (see paragraphs [0102] to [0126]). More detailed descriptions of polymerization mechanisms and related chemistry are discussed for ATRP (Chapter 11, pages 523 to 628) and RAFT (Chapter 12, pages 629 to 690) in Matyjaszewski et al.

In one embodiment the controlled radical polymerization process may be a RAFT process. In RAFT polymerization, chain transfer agents are important. A more detailed review of suitable chain transfer agents is found in paragraphs 66 to 71 of U.S. Patent Application U.S. 2005/038146. In one embodiment a suitable RAFT chain transfer agent includes 2-dodecylsulphanylthiocarbonylsulphanyl-2-methylpropionic acid butyl ester, cumyl dithiobenzoate, or mixtures thereof.

The amount of the block copolymer in a lubricant may be 0.01 to 0.3 percent by weight of the lubricant, or 0.02 to 0.27 weight percent or 0.05 to 0.25 weight percent, or 0.01 to 0.4, or 0.02 to 0.3, or 0.05 to 0.3 weight percent.

The overbased calcium or magnesium detergent (c) or detergents are known materials. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. They are prepared by reacting an acidic material (typically an inorganic acid or lower carboxylic acid such as carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

The metal compounds useful in making basic metal salts are generally any Group 1 or Group 2 metal compounds (CAS version of the Periodic Table of the Elements), but for the present technology, the metal compound will be a basic calcium or magnesium compound such as calcium oxide, calcium hydroxide, magnesium oxide, or magnesium hydroxide. Such overbased calcium or magnesium materials are well known to those skilled in the art.

Patents describing techniques for making basic salts of any of a variety of acids are known, including sulfonic acids, carboxylic acids, (hydrocarbyl-substituted) phenols, phosphonic acids, and mixtures of any two or more of these: see for instance U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Other useful types of detergents include saligenin detergents, disclosed in greater detail in U.S. Pat. No. 6,310,009, with special reference to their methods of synthesis (Column 8 and Example 1) and preferred amounts of the various species of X and Y (Column 6). Salixarate detergents and methods of their preparation are described in greater detail in U.S. Pat. No. 6,200,936 and PCT Publication WO 01/56968. Overbased glyoxylic detergents and their methods of preparation are disclosed in greater detail in U.S. Pat. No. 6,310,011. Overbased salicylate detergents and their methods of preparation are disclosed in U.S. Pat. Nos. 4,719,023 and 3,372,116. Other overbased detergents can include overbased detergents having a Mannich base structure, as disclosed in U.S. Pat. No. 6,569,818. Any of the foregoing acid materials may be used to form the present overbased detergent.

In one embodiment the lubricants of the present invention can contain an overbased calcium sulfonate detergent. Suitable sulfonic acids include sulfonic and thiosulfonic acids, and, in one embodiment, the sulfonic acid is not a thiosulfonic acid. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$—$(SO_3—)_b$, where T is a cyclic nucleus such as typically a benzene ring; $R_2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ in the above formulas can also contain other inorganic or organic substituents. In the above formulas, a and b are at least 1 (at least 1 $SO_3^-$ group on the molecule). In one embodiment the sulfonate detergent may be a predominantly linear alkylbenzenesulfonate detergent having a metal ratio of at least 8 as described in paragraphs [0026] to [0037] of U.S. Patent Application 2005-065045.

The amount of the overbased calcium detergent in the formulations of the present invention is typically an amount to provide a total calcium plus magnesium concentration in the lubricant of 0.015 to 0.35, or 0.015 to 0.2, or 0.015 to 0.15 percent by weight, or alternatively 0.03 to 0.1 percent by weight or 0.05 to 0.15 or to 0.08 percent by weight. The amount of calcium, if present, may be 0.015, or 0.03, or 0.1, to 0.35, or to 0.2, or to 0.15, or to 0.1, or to 0.8 weight percent. In one embodiment, the overbased calcium or magnesium detergent comprises an overbased calcium sulfonate detergent present in an amount to provide at least 0.03 percent by weight of calcium to the lubricant. The amount of magnesium, if present, may be 0.015, or 0.03, or 0.1, to 0.35, or to 0.2, or to 0.15, or to 0.1, or to 0.8 weight percent. In certain embodiments the amount of magnesium may be less than 0.01 weight percent. In certain embodiments, the overbased calcium detergent comprises a calcium sulfonate detergent, and it is present in an amount to provide at least 0.03 percent by weight of calcium to the lubricant, alternatively, 0.03 to 0.35 percent or 0.05 to 0.15 percent. The amount of TBN supplied to the lubricant by the overbased calcium detergent (or overbased calcium sulfonate detergent) maybe 0.7 to 9.0 or 1.3 to 4.0. The actual amount of the overbased calcium detergent required to provide the indicated amount of calcium will depend, of course, on the amount of calcium in the detergent composition and thus on the extent of overbasing. For a typical detergent, which may have, for instance, a TBN (total base number) of about 520 (corrected for amount of diluent oil) and a Ca content of about 21% (corrected), suitable overall amounts may be 0.05 to 0.1 percent by weight or alternatively 0.07 to 0.7 or to 0.1 to 0.5 or 0.2 to 0.4 percent by weight. Either a single detergent or multiple detergents can be present, and other detergents than the calcium overbased detergent may also be present.

The composition also includes (d) a phosphorus-containing anti-wear agent that does not contribute to the metal content of the lubricant. For instance, the antiwear agent is not a metal salt and, in particular, is different from the very commonly used antiwear agent, zinc dialkyldithiophosphate (ZDDP). This does not mean that the lubricant composition is necessarily free or substantially free from ZDDP or other metal-containing anti-wear agents, but if they are present, they will not count as the phosphorus-containing anti-wear agent of (d). In certain embodiments, the amount of ZDDP may be less than 1 percent by weight or less than 0.5 percent by weight, e.g., 0.001 to 0.5 percent or 0.01 to 0.2 percent or 0.03 to 0.1 percent. However, in certain embodiments the lubricant composition is free or substantially free from metal-containing anti-wear agents and may be free or substantially free from ZDDP. "Free from" may mean that none of the substance is intentionally added or that the amount present is not detectable by common methods or is not detectable at greater than contaminant amounts. "Substantially free from" means that the material is present in an amount less than that amount which will have a commercially useful benefit for the property in question, in this instance, anti-wear performance. In certain embodiments, "substantially free from" may mean an amount of ZDDP that provides less than 0.01 wt. % phosphorus, or less than 0.005 wt. % phosphorus, to the composition.

It is known that some of the materials described herein, including but not limited to the phosphorus compounds, may interact in the final formulation, so that the components of the final formulation may be different from those that are initially added. For instance, metal ions (of, e.g., a detergent) can migrate to other acidic or anionic sites of other molecules such as an anti-wear agent. The products formed thereby, including the products formed upon employing the composition of the present invention in its intended use, may not be susceptible of easy description. Nevertheless, all such modifications and reaction products are included within the scope of the present technology; the present technology encompasses the composition prepared by admixing the components described herein.

In several embodiments the amount of the phosphorus-containing antiwear agent present in the lubricating composition is 0.01 wt % to 15 wt %, or 0.05 wt % to 10 wt %, or 0.075 wt % to 5 wt % or 0.1 wt % to 3 wt % of the lubricating composition. Alternatively expressed, they may be present in an amount suitable to provide 0.01 to 0.25 or 0.03 to 0.2 or 0.038 to 0.15 or 0.041 to 0.13 or 0.042 to 0.10 or 0.05 to 0.15 percent by weight phosphorus to the lubricant, which may, or may not, be provided from a dialkyl hydrogen phosphite. Such amounts may be readily determined knowing the phosphorus content of the particular antiwear agent. The total amount of phosphorus in the lubricating composition, by analysis, for instance, will include the amount of phosphorus derived from the above phosphorus-containing antiwear agent, plus phosphorus from any other sources such as ZDDP (if present).

The phosphorus-containing antiwear agent, then, may comprise one or more of a phosphorus acid ester; a phosphorus-containing carboxylic acid, ester, or amide; a phosphorus-containing ether; or a phosphite, including phosphoric acid esters or salt thereof, hydrocarbyl-substituted phosphites, phosphorus-containing carboxylic esters, phosphorus-containing carboxylic ethers, and phosphorus-containing carboxylic amides, or mixtures thereof. In one embodiment the antiwear agent includes a hydrocarbyl-substituted phosphite, a phosphorus-containing carboxylic ester, a phosphorus-containing carboxylic ether, a phosphorus-containing carboxylic amide, or mixtures thereof.

In one embodiment the antiwear agent is a hydrocarbyl-substituted phosphite. The hydrocarbyl-substituted phosphite may include those represented by the formula $(R^1O)PH(=O)(OR^2)$ wherein $R^1$ and $R^2$ are independently hydrogen or hydrocarbyl groups, with the proviso that at least one of $R^1$ and $R^2$ is a hydrocarbyl group. When $R^1$ and/or $R^2$ are hydrocarbyl groups, each may contain at least 2 or 4 carbon atoms. Typically, the combined total sum of carbon atoms present on $R^1$ and $R^2$ is less than 45, less than 35 or less than 25. Examples of suitable ranges for the number of carbon atoms present on $R^1$ and/or $R^2$ include 2 to 40, 3 to 20, or 4 to 10. Examples of suitable hydrocarbyl groups include propyl, butyl, t-butyl, pentyl or hexyl groups. A suitable phosphite is dibutyl phosphite, which is a commercially available material. In one embodiment, this material may be present in an amount to provide at least 410 ppm by weight of phosphorus to the lubricant. Generally the hydrocarbyl-substituted phosphite is soluble or at least dispersible in oil.

Other phosphorus-containing anti-wear agents include hydrocarbyl phosphates, such as a mono-, di- or trihydrocarbyl phosphate. The hydrocarbyl groups may each independently contain 1 to 30 or to 24 or to 12 carbon atoms Examples of hydrocarbyl groups include butyl, amyl, hexyl, octyl, oleyl or cresyl, as well as hydrocarbylene groups derived from any of a number of diols. The hydrocarbyl phosphates may be prepared by reacting phosphorus acid or anhydride, such as phosphorus pentoxide with an alcohol, generally in a weight ratio of 1:3.5 or 1:3, at a temperature of 30° C. to 200° C.

In another embodiment, the hydrocarbyl phosphate may be a hydrocarbyl thiophosphate, containing one to three sulfur atoms, which may be prepared by reacting one or more of the above-described phosphites with a sulfurizing agent such as sulfur.

In another embodiment, the antiwear agent may be a phosphorus-containing amide. Phosphorus-containing amides are generally prepared by reacting a phosphorus acid such as a phosphoric, phosphonic, phosphinic, thiophosphoric, including dithiophosphoric as well as monothiophosphoric, thiophosphinic or thiophosphonic acid with an unsaturated amide, such as an acrylamide. In one embodiment the phosphorus acid is a dithiophosphorus acid prepared by reacting a phosphorus sulfide with an alcohol or phenol to form dihydrocarbyl dithiophosphoric acid. The hydrocarbyl groups may be those described above for hydrocarbyl phosphates.

In one embodiment, examples of this type of component include amine salts of partial esters of phosphoric or thiophosphoric acids. In another embodiment, the phosphorus-containing antiwear agent may comprise a mixture of hydrocarbyl esters of a phosphoric acid alkylamine salt or of a sulfur-containing phosphoric acid alkylamine salt.

In one embodiment, the phosphorus-containing acid may be a phosphorus acid ester prepared by reacting one or more phosphorus acids or anhydrides with an alcohol containing 1 to 3 carbon atoms. The alcohol generally contains up to 30, or to 24, or to 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, a phosphorus halide, a lower phosphorus ester, or a phosphorus sulfide, including phosphorus pentasulfide. Lower phosphorus acid esters may contain 1 to 7 carbon atoms in the alcohol-derived portion of each ester group. The phosphorus acid ester may be a mono- or diphosphoric acid esters. Alcohols used to prepare the phosphorus acid esters may include butyl, amyl, 2-ethylhexyl, hexyl, octyl, decyl and oleyl alcohols as well as commercially available alcohols and mixtures thereof such as Alfol™ 810 (a mixture of primarily straight chain, primary alcohols having from 8 to 10 carbon atoms); Alfol™ 1218 (a mixture of synthetic, primary, straight-chain alcohols containing 12 to 18 carbon atoms); Alfol™ 20+ alcohols (mixtures of $C_{18}$-$C_{28}$ primary alcohols having mostly $C_{20}$ alcohols as determined by GLC (gas-liquid-chromatography)); and Alfol™ 22+ alcohols ($C_{18}$-$C_{28}$ primary alcohols containing primarily $C_{22}$ alcohols), available from Conoco Phillips. Also suitable are other commercial mixtures of fatty alcohols containing mainly 12, 14, 16, or 18 carbon atoms. Fatty vicinal diols also are useful.

In another embodiment, the phosphorus-containing acid is a thiophosphorus acid ester. The thiophosphorus acid esters may be mono- or dithiophosphorus acid esters. Thiophosphorus acid esters are also referred to generally as thiophosphoric acids. The thiophosphorus acid ester may be prepared by reacting a phosphorus sulfide, such as those described above, with an alcohol, such as those described above.

In one embodiment, a dithiophosphoric acid such as di(methyl-2-pentyl)dithiophosphoric acid may be reacted with an epoxide or a glycol or chloroglycerine. This reaction product is further reacted with a phosphorus acid, anhydride, or lower ester, optionally in the presence of a small amount of alcohol such as 4-methyl-2-pentanol. The epoxide is generally an aliphatic epoxide or a styrene oxide. Examples of useful epoxides include ethylene oxide, propylene oxide, butene oxide, octene oxide, dodecene oxide, and styrene oxide. Acidic phosphoric acid esters may be reacted with ammonia or an amine compound to form an ammonium salt. The salts may be formed separately and then the salt of the phosphorus acid ester may be added to the lubricating composition. Alternately, the salts may also be formed in situ when the acidic phosphorus acid ester is blended with other components to form a fully formulated lubricating composition. Additionally, metal salts such as zinc salts may be present due to, e.g., cation exchange with other salts in a lubricant formulation.

The amine salts of the phosphorus acid esters may be formed from ammonia or an amine, including monoamines and polyamines. The amines may be primary amines, secondary amines or tertiary amines. Useful amines include those amines disclosed in U.S. Pat. No. 4,234,435 at col. 21, line 9 to col. 22, line 5.

The monoamines generally contain from 1 to 24 carbon atoms, or to 14, or to 8 carbon atoms. Examples of monoamines include but are not limited to methylamine, ethylamine, propylamine, butylamine, octylamine, and dodecylamine, dimethylamine, diethylamine, dipropylamine, dibutylamine, methyl butylamine, ethyl hexylamine, trimethylamine, tributylamine, methyl diethylamine, ethyl dibutylamine, n-hexylamine, n-octylamine, n-decylamine, n-dodecylamine, n-tetradecylamine, n-hexadecylamine, n-octadecylamine, and oleylamine. A useful amine is a C1214 branched tertiary alkyl primary amine available under the trade name Primene™ 81R. The polyamines include alkoxylated diamines, fatty diamines, alkylenepolyamines, hydroxy-containing polyamines, condensed polyamines and heterocyclic polyamines. In one embodiment, the amine may be a hydroxyamine such as N-(2-hydroxyethyl)hexylamine; N-(2-hydroxyethyl) octylamine; N-(2-hydroxyethyl) pentadecylamine; N-(2-hydroxyethyl) oleylamine; N-(2-hydroxyethyl)soyamine; N,N-bis(2-hydroxyethyl) hexylamine; N,N-bis(2-hydroxyethyl)oleylamine; N-(2-hydroxyethoxyethyl)hexylamine; or N,N-bis(2-hydroxyethoxyethyl)oleylamine.

In certain embodiments the anti-wear agent may be a sulfur-free amine salt or metal salt or mixed amine/metal salt of either (i) a hydroxy-substituted di-ester of phosphoric acid, or (ii) a phosphorylated hydroxy-substituted di- or tri-ester of phosphoric acid. Such a material may be present or may be absent. It may be obtained by reacting an amine as disclosed above with either (i) a hydroxy-substituted di-ester of phosphoric acid, or (ii) a phosphorylated hydroxy-substituted di- or tri-ester of phosphoric acid. Such materials are described, for instance, in U.S. Patent Publication 2008-0182770, see, for instance, formula (1a) therein, and may be viewed, in certain embodiments, as sulfur-free analogues of the above-described thiophosphorus acid esters and salts. In particular, the anionic portion of such a salt may have a structure represented by

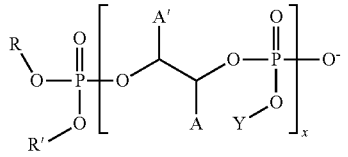

and the cationic portion may be an amine or ammonium ion represented by $H_mN^+R''_n$ or a mixed nitrogen/metal ion represented by $[H_mN^+R''_n]_q[M]_e$. In the above formulas, each A and A' is independently H or a hydrocarbyl group containing 1 to 30 carbon atoms; R and R" are independently hydrocarbyl groups; R' is H or a hydroxyalkyl group; each Y is independently R' or a group represented by RO(R'O)P(O)—CH(A')CH(A)- (such as, in one embodiment, RO(R'O)P(O)—$CH_2CH(CH_3)$—); x is 0 or 1, provided that when x=0, R' is a hydroxyalkyl group; and m and n are both positive integers such that that the sum of (m+n) is 4. Moreover, M is a metal ion; and q and e are numbers whose total provides the complete valence to satisfy the valence of the number of anions associated therewith: in a particular embodiment, q is 0.1 to 1.5 (or 0.1 to 1) and e is 0 to 0.9. In certain embodiments, the anti-wear agent comprises a sulfur-free amine salt of a phosphorus compound obtained or obtainable by a process comprising reacting an amine with (i) a hydroxy-substituted di-ester of phosphoric acid, (ii) a phosphorylated hydroxy-substituted di- or tri-ester of phosphoric acid, or mixtures thereof.

Friction modifiers (e) are well known to those skilled in the art. In particular, a desirable friction modifier is one that will reduce the static coefficient of friction between surfaces, and especially at a metal-composition (i.e., non-metal such as cellulosic) interface, such as is characteristic of a wet clutch or wet brake found in a farm tractor. It is desirable that the friction modifier impart to the lubricant a low static coefficient of friction while retaining high dynamic friction, to minimize lurching or shuddering upon application of the brake or operation of the transmission.

A useful list of friction modifiers is included in U.S. Pat. No. 4,792,410. U.S. Pat. No. 5,110,488 discloses metal salts of fatty acids and especially zinc salts, useful as friction modifiers. A list of friction modifiers includes fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylates, and mixtures thereof.

Representatives of each of these types of friction modifiers are known and are commercially available. Fatty acids, for instance, can be used in preparing the glycerol esters of fatty acids; they can also be used in preparing their metal salts, amides, or imidazolines, any of which can be used as friction modifiers. Fatty acids as used in this application include those containing 6 to 24 carbon atoms, such as 8 to 18. The acids can be branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. Suitable metal salts include zinc and calcium salts, and they may be salts of oleic acid, e.g., zinc oleate.

Suitable amides are those prepared by condensation of fatty acids with ammonia or with primary or secondary amines such as diethylamine and diethanolamine. Fatty imidazolines are the cyclic condensation product of a fatty acid with a diamine or polyamine such as a polyethylene-polyamine. The imidazolines are generally represented by the structure

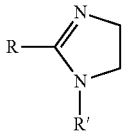

where R is an alkyl group and R' is hydrogen or a hydrocarbyl group or a substituted hydrocarbyl group, including $—(CH_2CH_2NH)_n—CH_2CH_2NH_2$ groups and isomers thereof, where n can be 0 to 8 or 1 to 6 or 2 to 4. In certain embodiments the friction modifier is the condensation product of a $C_8$ to $C_{24}$ fatty acid with a polyalkylene polyamine, and in particular, the product of isostearic acid with tetraethylenepentamine. The condensation products of carboxylic acids and polyalkyleneamines may generally be imidazolines or amides and are often mixtures of such species. Of course, as with any friction modifier or other additive, materials are less desirable and may be avoided if they impart deleterious properties for unrelated reasons. For instance, 1-hydroxyethyl-2-heptadecenyl imidazoline may be avoided if copper corrosion is found to be of concern.

Among the amines that may be used as friction modifiers, either alone or as borated amines, are commercial alkoxylated fatty amines and fatty amines themselves, which are commercially available (where fatty amines, as used in this specification, may contain 6 to 24 or 8 to 20 carbon atoms). Some of them are known by the trademark "ETHOMEEN" and available from Akzo Nobel. Representative examples of these Ethomeen™ materials include Ethomeen™ C/12 (bis[2-hydroxyethyl]-coco-amine); Ethomeen™ C/20 (polyoxyethylene[10]cocoamine); Ethomeen™ S/12 (bis[2-hydroxyethyl]soyamine); Ethomeen™ T/12 (bis[2-hydroxyethyl]allow-amine); Ethomeen™ T/15 (polyoxyethylene-[5]tallowamine); Ethomeen™ 0/12 (bis[2-hydroxyethyl]oleylamine); Ethomeen™ 18/12 (bis[2-hydroxyethyl]octadecylamine); and Ethomeen™ 18/25 (polyoxyethyl-ene[15]octadecylamine). Fatty amines and ethoxylated fatty amines are also described in U.S. Pat. No. 4,741,848. Other amine friction modifiers include long chain secondary or tertiary amines as disclosed in U.S. 2006-0172899. Examples include tertiary amines being represented by the formula $R^1R^2NR^3$ wherein $R^1$ and $R^2$ are each independently an alkyl group of at least 6 carbon atoms and $R^3$ is a polyol-containing alkyl group, e.g., $R^1R^2N—CH_2—CHOH—CH_2OH$, wherein $R^1$ and $R^2$ are each independently alkyl groups of 8 to 20 carbon atoms.

The amount of friction modifier in the lubricant is the amount suitable to reduce the static coefficient of friction at a metal-composition interface, compared to the friction in the absence of the friction modifier. Suitable amounts include 0.2 to 2 weight percent, or 0.4 to 1.5 weight percent, or 0.6 to 1.0 weight percent.

One or more of other materials that are commonly used in farm tractor lubricants may optionally also be included in the present formulations, in conventional amounts; alternatively, any one or more of them may be excluded, as desired. Examples include antioxidants, corrosion inhibitors, extreme pressure agents and anti-wear agents in addition to those previously described. These include chlorinated aliphatic hydrocarbons, boron-containing compounds including borate esters, and molybdenum compounds. Other additives are viscosity improvers in addition to those previously described, which include polyisobutenes, polymethacrylate esters, polyacrylate esters, diene polymers, polyalkylstyrenes, alkenylaryl conjugated diene copolymers, polyolefins and multifunctional viscosity improvers. Also included may be pour point depressants, which are often included in the lubricating oils described herein. See for example, page 8 of "Lubricant Additives" by C. V. Smalheer and R. Kennedy Smith (Lesius-Hiles Company Publishers, Cleveland, Ohio, 1967). Anti-foam agents can be used to reduce or prevent the formation of stable foam, and include silicones or organic polymers. Sulfurized organic materials can also be present. Materials which may be sulfurized to form the sulfurized organic compositions include oils, fatty acids or esters, olefins or polyolefins made thereof, terpenes, or Diels-Alder adducts. Sulfurized olefins can be produced by reacting sulfur monochloride with a low carbon atom olefin, treating the resulting product with an alkali metal sulfide in the presence of free sulfur, and reacting that product with an inorganic base, as described by reference to U.S. Pat. No. 3,471,404.

Another additive which can be present is a dimercaptothiadiazole or a derivative thereof, which can be used as a copper corrosion inhibitor. These materials are prepared by reaction of $CS_2$ with hydrazine. Dimercaptothiadiazoles consist of a five-membered ring. The carbon atoms are substituted by sulfur-containing groups, in particular —S—H, —S—R, or —S—S—R groups, where R is hydrocarbyl group. These and other additives are described in greater detail in U.S. Pat. No. 4,582,618 (column 14, line 52 through column 17, line 16, inclusive).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0118] to [0119] of International Publication WO2008147704.

EXAMPLES

The following formulations are prepared. Amounts are in percent by weight (including diluent oil when noted):

| | Ex: | | | |
|---|---|---|---|---|
| | 1* (ref) | 2* (ref) | 3 | 4 |
| Block copolymer[a] incl. 50% oil | | | 0.20 | 0.20 |
| Random copolymer[b] incl. 50% oil | 0.20 | 0.20 | | |
| Overbased Ca detergent, incl. 42% oil, 300 TBN, 12% Ca (as is, with 42% oil) | 0.61 | 0.61 | 0.61 | 0.61 |
| P-containing antiwear agents: | | | | |
| Di-butyl phosphite | 0.39 | 0.39 | 0.42 | 0.42 |
| Mixture of hydrocarbyl esters of sulfur-containing phosphoric acid alkylamine salt | 0.60 | 0.60 | 0.63 | 0.63 |
| Similar ester mixture, non-sulfur containing | 0.09 | 0.09 | | |
| Friction modifiers: | | | | |
| Isostearic acid-tetraethylene pentamine condensate | 0.35 | 0.63 | 0.38 | 0.35 |
| Ethomeen ™ T-12 | 0.14 | 0.14 | 0.14 | 0.14 |
| Zinc oleate | 0.32 | 0.32 | 0.32 | 0.32 |
| Polymethacrylate viscosity modifier, 28% oil | 4.80 | 4.80 | 4.80 | 4.60 |
| Succinimide dispersant 1 (41% oil) | 1.70 | 1.60 | 1.53 | 1.76 |
| Succinimide dispersant 2 (40% oil) | | 0.20 | 0.20 | |
| Succinimide dispersant 3 (42% oil) | | | 0.20 | 0.20 |
| Succinic[c] ester/amide corrosion inhibitor (49% oil) | 0.50 | 0.50 | 0.50 | 0.50 |
| Succinic[c] acid condensate with diethanolamine (33% oil) | 0.25 | 0.20 | 0.20 | 0.20 |

-continued

| | Ex: | | | |
|---|---|---|---|---|
| | 1* (ref) | 2* (ref) | 3 | 4 |
| Polyisobutylene succinic anhydride | 0.07 | 0.05 | 0.07 | 0.07 |
| Aminic and sulfur-containing antioxidants | 0.59 | 0.59 | 0.59 | 0.59 |
| Boron-containing friction modifier | 0.23 | 0.23 | 0.23 | 0.23 |
| Corrosion inhibitors | 0.26 | 0.26 | 0.26 | 0.26 |
| Antifoam agents, commercial sol'n. | 0.014 | 0.016 | 0.017 | 0.017 |
| Oils of lubricating viscosity | remainder to add to 100% | | | |
| % phosphorus in composition | 0.116 | 0.115 | 0.118 | 0.117 |
| % calcium in composition | 0.072 | 0.072 | 0.073 | 0.071 |

*A reference example.

[a]A diblock copolymer of (lauryl methacrylate and $C_{16-18}$-alkyl methacrylate)-b-dimethylaminoethyl methacrylate, molecular weight about 57,000. 1500 g of lauryl methacrylate, 260 g of $C_{16-18}$-alkyl methacrylate, and 3 g of Trigonox ® 21 initiator are blended in oil. One third of the blend is charged into a flask, to which 17.5 g of dodecyl-trithiocarbonate butyl ester chain transfer agent is added. The flask is stirred and purged with nitrogen (0.056 $m^3$/hr, 2SCFH) for 30 minutes, then heated to 80° C., the nitrogen flow reduced to 0.014 $m^3$/hr (0.5 SCFH), and the remaining two thirds of the blend added over 90 minutes. The flask is maintained at 80° C. and held for 15 hours, then charged with 240 g of dimethylaminoethyl methacrylate and held for at 90° C. for 2 hours. Three separate charges (each 1 g) of Trigonox ® 21 initiator are added over a period of 5 hours. The product is a viscous liquid before additional dilution with diluent oil to form a 50% polymer mixture in oil.

[b]Random copolymer from 85% by weight lauryl methacrylate and 15% by weight stearyl methacrylate, weight average molecular weight about 10,000 to 100,000.

[c]Hydrocarbyl-substituted, as also are the succinimide dispersants.

The above lubricant formulations are subjected to water tolerance testing. In Test 1 a 100 mL sample of lubricant is blended with 2 mL distilled water for 5 minutes in a paint shaker. The sample is stored for 7 days and is evaluated, reporting the percent by volume of emulsion phase, free water phase, and sediment.

In Test 2, 200 mL of the test fluid is mixed at high speed (12,000 to 14,000 rpm) with 0.8 mL distilled water for 1 minute. A 100 mL sample is placed into a centrifuge tube, stoppered, and stored in a dark cabinet at room temperature for 7 days. Thereafter the sample is evaluated and the percent by volume of emulsion phase, free water phase, and sediment are reported. The sample is subsequently subjected to centrifugation for 1 hour and the observations are repeated.

Results are shown in the table below:

| | | Ex: | | | |
|---|---|---|---|---|---|
| | | 1* (ref) | 2* (ref) | 3 | 4 |
| Test 1: | Amount emulsion | 2.1 | 1.3 | 0.05 | 0.02 |
| | Amount free water | 0.7 | 0.7 | 0 | 0 |
| | Amount sediment | 0 | 0 | 0 | 0 |
| Test 2, before centrifugation: | Amount emulsion | 0 | 0 | 0 | 0 |
| | Amount free water | 0.02 | 0.03 | 0 | 0 |
| | Amount sediment | 0 | 0 | 0 | 0 |
| after centrifugation: | Amount emulsion | 0 | 0 | 0.001 | 0.001 |
| | Amount free water | 0.15 | 0.15 | 0 | 0 |
| | Amount sediment | 0 | 0 | 0 | 0 |

*a reference or comparative example

The results show that compositions of the present invention exhibit excellent water tolerance.

Tests on similar samples illustrate that in certain formulations, amounts of P of at least 0.1 percent by weight provide even better water tolerance than formulations containing less than 0.09% P. Occasionally, therefore, it may be desirable to provide at least 0.1% by weight phosphorus in the formulation, for instance, if the amount of Ca is less than 0.2% or less than 0.1%.

| | Ex: 5 | Ex: 6 |
|---|---|---|
| Block copolymer as in Ex. 3, incl. 50% oil | 0.20 | 0.20 |
| Overbased Ca detergent, 300 TBN, 12% Ca, incl. 42% oil | 0.51 | 0.51 |
| P-containing antiwear agents: | | |
| Di-butyl phosphite | 0.42 | 0.23 |
| Mixture of hydrocarbyl esters of sulfur-containing phosphoric acid alkylamine salt | 0.63 | 0.62 |
| eFriction modifiers: | | |
| Isostearic acid-tetraethylene pentamine condensate | 0.23 | 0.23 |
| Ethomeen ™ T-12 | 0.14 | 0.14 |
| Zinc oleate | 0.32 | 0.32 |
| Ester of hydroxy acid | — | 0.15 |
| Polymethacrylate viscosity modifier, 53% oil | 6.06 | 5.40 |
| Succinimide dispersants, ~41% oil | 1.92 | 1.92 |
| Polyisobutylene succinic anhydride | 0.08 | 0.08 |
| Aminic and sulfur-containing antioxidants | 0.36 | 0.36 |
| Boron-containing friction modifier | 0.23 | 0.23 |
| Corrosion inhibitors | 0.49 | 0.49 |
| Antifoam agents, commercial sol'n. | 0.018 | 0.018 |
| Oils of lubricating viscosity | remainder to add to 100% | |
| % phosphorus in composition | 0.114 | 0.088 |
| % calcium in composition | 0.071 | 0.073 |

When the formulations are subjected to water tolerance test #1 (described above), the results are as follows:

| | | Ex: 5 | Ex: 6 |
|---|---|---|---|
| Test 1: | Amount emulsion | 0.04 | 0.6 |
| | Amount free water | 0 | 0 |
| | Amount sediment | 0 | 0 |

A formulation is prepared that is characteristic of a lubricant for a manual transmission, as shown below (amounts of components shown absent their conventional diluent oil):

| | Ex: 7* (ref) | Ex: 8 |
|---|---|---|
| Block copolymer as in Ex. 3 | — | 0.1 |
| Random copolymer as in Ex 1 (ref) | 0.1 | — |
| Overbased calcium detergents | 0.47 | 0.47 |
| Dibutyl hydrogen phosphite (dibutyl phosphite) | 0.3 | 0.3 |
| Long chain alkyl phosphite | 0.16 | 0.16 |
| Borate ester friction modifier | 0.2 | 0.2 |
| Succinimide dispersant materials | 1.74 | 1.74 |
| 85% Phosphoric acid | 0.1 | 0.1 |
| Antioxidant(s) | 0.6 | 0.6 |
| Corrosion inhibitor(s) | 0.2 | 0.2 |
| Seal swell agent | 0.5 | 0.5 |
| Commercial antifoam agent | 0.02 | 0.02 |
| Methacrylate random copolymer | 30.5 | 30.5 |
| Oils of lubricating viscosity | remainder to add to 100% | |

Samples of Ex. 7 and 8 are subjected to a water compatibility test that involves combining 99.5 mL of lubricant with 0.5 mL distilled water. The mixtures are shaken vigorously by hand for 5 minutes. Samples are evaluated after storage for 5 days at room temperature and at 66° C. (150° F.). Samples are evaluated for the presence of haziness, precipitation, or gel and for change in concentration of phosphorus, boron, and calcium by ICP-AES, ASTM D5185 (changes should not exceed 15% for a passing result). Results are shown in the following table:

| Fresh lubricant sample | | |
|---|---|---|
| % P | 0.0772 | 0.0767 |
| % B | 0.0147 | 0.0136 |
| % Ca | 0.0656 | 0.0675 |
| After 5 days, room temp | | |
| precipitation | present | present |
| haziness | present | present |
| Formation of Gel | None (pass) | None (pass) |
| % P (% change) | 0.0773 (0.1%) | 0.743 (3.1%) |
| % B | 0.0151 (2.7%) | 0.0136 (0%) |
| % Ca | 0.0677 (3.7%) | 0.0693 (2.7%) |
| After 5 days, 66° C. | | |
| precipitation | present | present |
| haziness | none | present |
| Formation of Gel | Present (fail) | None (pass) |
| % P | 0.0406 (47%) (fail) | 0.0752 (2.0%) |
| % B | 0.0058 (60%) (fail) | 0.0124 (8.8%) |
| % Ca | 0.0023 (96%) (fail) | 0.0667 (1.3%) |

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a metal-composition interface of a wet-brake component of a farm tractor, comprising supplying thereto a lubricant comprising:

(a) an oil of lubricating viscosity;

(b) about 0.01 to about 0.3 weight percent of a block copolymer comprising:

(i) at least one hydrophobic block having $C_{1-30}$ alkyl (meth)acrylic units, with the proviso that $C_{1-30}$ alkyl groups of the $C_{1-30}$ alkyl (meth)acrylic units have a number-average number of carbon atoms of at least about 8; and (ii) at least one additional block having (meth)acrylic units, at least some units of which comprise a heteroatom in the non-acid portion of the (meth)acrylic unit, imparting polar character to said block in excess of the polar character of the hydrophobic block;

(c) at least one overbased calcium or magnesium detergent in an amount to provide a total calcium plus magnesium concentration in the lubricant of about 0.015 to about 0.35 percent by weight;

(d) at least one phosphorus-containing anti-wear agent that does not contribute to the metal content of the lubricant; and (e) at least one friction modifier suitable to reduce the static coefficient of friction between the surfaces of the metal-composition interface;

wherein said lubricant contains less than about 0.5 percent by weight of a zinc dialkyl dithiophosphate.

2. The method of claim 1 wherein, in the hydrophobic block of the block copolymer, at least 50 wt % of the $C_{1-30}$ alkyl (meth)acrylic units are $C_{12-15}$ alkyl (meth)acrylic units, and up to 50 wt % of the $C_{1-30}$ alkyl (meth)acrylic units are $C_{16-20}$ alkyl (meth)acrylic units, the weight percent being calculated based on the weight of the entire alkyl (meth) acrylic monomer units.

3. The method of claim 1 wherein the heteroatom-containing units in the block copolymer comprise an oxygen atom, a nitrogen atom, or a sulfur atom in the non-acid portion of the monomer units.

4. The method of claim 1 wherein the heteroatom-containing units in the block copolymer are derived from a nitrogen containing monomer selected from the group consisting of dimethylaminoethyl acrylate, dimethylaminoethyl methacrylate, dimethylaminopropyl methacrylate, dimethylaminopropyl acrylate, dimethylaminopropylacrylamide, dimethylaminopropylmethacrylamide, and mixtures thereof, or from an oxygen-containing monomer selected from the group consisting of 2-hydroxyethyl acrylate, 2-hydroxyethyl methacrylate, and mixtures thereof.

5. The method of claim 1 wherein the weight average molecular weight of the block copolymer is about 1000 to about 400,000 and the weight ratio of the hydrophobic block or blocks to the additional block or blocks is about 2:1 to about 100:1.

6. The method of claim 1 wherein the one or more overbased calcium or magnesium detergents comprise an overbased calcium sulfonate detergent.

7. The method of claim 1 wherein the amount of the one or more overbased calcium or magnesium detergents is about 0.05 to about 1.5 weight percent.

8. The method of claim 1 wherein the overbased calcium or magnesium detergent comprises an overbased calcium sulfonate detergent and is present in an amount to provide at least 0.03 percent by weight of calcium to the lubricant.

9. The method of claim 1, being substantially free of a zinc dialkyl dithiophosphate.

10. The method of claim 1 wherein the phosphorus-containing antiwear agent comprises: a phosphorus acid ester; a phosphorus-containing carboxylic acid, ester, or amide; a phosphorus-containing ether; or a phosphite.

11. The method of claim 1 wherein the phosphorus-containing antiwear agent is present in an amount to provide about 0.01 to about 0.25 percent by weight phosphorus to the lubricant.

12. The method of claim 1 wherein the phosphorus-containing antiwear agent comprises dibutyl phosphite which is present in an amount to provide at least about 410 ppm by weight of phosphorus to the lubricant.

13. The method of claim 1 wherein the friction modifier comprises a metal salt of a fatty acid of about 6 to about 24 carbon atoms, or a condensation product of a fatty acid of about 6 to about 24 carbon atoms with a polyalkylene polyamine, an alkoxylated fatty amine, a fatty phosphite, or mixtures thereof.

14. The method of claim 1 wherein the amount of the friction modifier is about 0.2 to about 2 weight percent.

* * * * *